US010424254B2

(12) United States Patent
An et al.

(10) Patent No.: US 10,424,254 B2
(45) Date of Patent: Sep. 24, 2019

(54) DRIVER INTEGRATED CIRCUIT AND DISPLAY DEVICE INCLUDING THE SAME

(71) Applicant: LG DISPLAY CO., LTD., Seoul (KR)

(72) Inventors: Changho An, Hwaseong-si (KR); Byungil Kim, Gimpo-si (KR)

(73) Assignee: LG Display Co., Ltd., Seoul (KR)

( * ) Notice: Subject to any disclaimer, the term of this patent is extended or adjusted under 35 U.S.C. 154(b) by 121 days.

(21) Appl. No.: 15/801,046

(22) Filed: Nov. 1, 2017

(65) Prior Publication Data

US 2018/0122305 A1 May 3, 2018

(30) Foreign Application Priority Data

Nov. 1, 2016 (KR) ..... 10-2016-0144569

(51) Int. Cl.
*G09G 3/3275* (2016.01)
*G09G 3/3258* (2016.01)

(52) U.S. Cl.
CPC ..... *G09G 3/3275* (2013.01); *G09G 3/3258* (2013.01); *G09G 2300/0408* (2013.01); *G09G 2300/0426* (2013.01); *G09G 2300/0814* (2013.01); *G09G 2300/0828* (2013.01); *G09G 2310/0291* (2013.01)

(58) Field of Classification Search
CPC ..... G09G 3/3275; G09G 3/3258; G09G 2300/0426; G09G 2300/0828; G09G 2300/0814; G09G 2300/0408; G09G 2310/0291
See application file for complete search history.

(56) References Cited

U.S. PATENT DOCUMENTS 9,930,283 B2 * 3/2018 Abiru ..... H04N 5/378
2005/0285822 A1 * 12/2005 Reddy ..... G06F 3/03542 345/76
2016/0104428 A1 * 4/2016 In ..... G09G 3/3275 345/214
2016/0360138 A1 * 12/2016 Meynants ..... H01L 27/14609
2018/0166515 A1 * 6/2018 An ..... G09G 3/3291

* cited by examiner

*Primary Examiner* — Amit Chatly
(74) *Attorney, Agent, or Firm* — Seed IP Law Group LLP

(57) ABSTRACT

A driver integrated circuit and a display device including the same are disclosed. The driver integrated circuit includes a data voltage generator that includes a digital-to-analog converter converting a digital signal into an analog signal, generates an analog data voltage in a display drive operation, and applies the analog data voltage to pixels of a display panel, a sensor that is connected to a sensing channel connected to the pixels of the display panel, shares the digital-to-analog converter with the data voltage generator, converts an analog sensing voltage indicating electrical characteristics of the pixels input from the sensing channel into digital sensing data in a sensing drive operation, and outputs the digital sensing data, and switching elements selectively operating in the display drive operation and the sensing drive operation.

18 Claims, 19 Drawing Sheets

FIG. 12

| | SW1 | SW2 | SW3 | SW4 |
|---|---|---|---|---|
| Display drive operation | ON | OFF | ON | OFF |
| Sensing drive operation | OFF | ON | OFF | ON |

FIG. 16

| | SW1 | SW2 | SW3 | SW4 | SW5 | SW6 |
|---|---|---|---|---|---|---|
| Display drive operation | ON | OFF | ON | OFF | ON | OFF |
| Sensing drive operation | OFF | OFF | OFF | ON | OFF | ON |

DRIVER INTEGRATED CIRCUIT AND DISPLAY DEVICE INCLUDING THE SAME

CROSS-REFERENCE TO RELATED APPLICATION

This application claims priority from and the benefit of Korea Patent Application No. 10-2016-0144569, filed Nov. 1, 2016, which is incorporated herein by reference for all purposes as if fully set forth herein.

BACKGROUND

Technical Field

The present disclosure relates to a driver integrated circuit and a display device including the same.

Description of the Related Art

Various types of flat panel displays have been developed and sold. Among the various types of flat panel displays, an electroluminescent display is classified into an inorganic electroluminescent display and an organic electroluminescent display depending on a material of an emission layer. In particular, an active matrix organic light emitting diode (OLED) display includes a plurality of OLEDs capable of emitting light by themselves and has many advantages, such as fast response time, high emission efficiency, high luminance, wide viewing angle, and the like.

An OLED serving as a self-emitting element includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When power (voltage) is applied to the anode electrode and the cathode electrode, holes passing through the hole transport layer HTL and electrons passing through the electron transport layer ETL move to the emission layer EMI, and form excitons. As a result, the emission layer EML generates visible light.

An OLED display includes a plurality of pixels, each including an OLED and a thin film transistor (TFT) that adjusts a luminance of an image implemented on the pixels based on a grayscale of image data. The driving TFT controls a driving current flowing into the OLED depending on a voltage (hereinafter, referred to as "a gate-to-source voltage") between a gate electrode and a source electrode of the driving TFT. An amount of light emitted by the OLED is determined depending on the driving current of the OLED, and the luminance of the image is determined depending on the amount of light emitted by the OLED.

In general, when a driving TFT operates in a saturation region, a driving current Ids flowing between a drain electrode and a source electrode of the driving TFT is expressed by the following Equation 1.

$$Ids=\tfrac{1}{2}*(\mu*C*W/L)*(Vgs-Vth)^2 \qquad \text{Equation 1:}$$

In the above Equation 1, μ is electron mobility, C is a capacitance of a gate insulating layer, W is a channel width of the driving TFT, and L is a channel length of the driving TFT. In addition, Vgs is a voltage between a gate electrode and a source electrode of the driving TFT, and Vth is a threshold voltage (or a critical voltage) of the driving TFT. A gate-to-source voltage Vgs of the driving TFT may be a differential voltage between a data voltage and a reference voltage in accordance with a pixel structure. The data voltage is an analog voltage corresponding to a grayscale of image data, and the reference voltage is a fixed voltage. Therefore, the gate-to-source voltage Vgs of the driving TFT is programmed or set depending on the data voltage. Then, the driving current Ids is determined depending on the programmed gate-to-source voltage Vgs.

Electrical characteristics of the pixel, such as the threshold voltage Vth and the electron mobility μ of the driving TFT and a threshold voltage of the OLED, may be factors in determining an amount of driving current Ids of the driving TFT. Therefore, all the pixels should have the same electrical characteristics. However, a variation in the electrical characteristics between the pixels may be caused by various factors such as manufacturing process characteristics and time-varying characteristics. The variation in the electrical characteristics between the pixels may lead to a luminance variation, and it is difficult to implement desired images or meet image quality requirements.

In order to compensate for the luminance variation between the pixels, there are so-called external compensation techniques for sensing electrical characteristics of the pixels and correcting (or compensating for) an input image based on the sensing result. In order to compensate for the luminance variation, a current change by an amount of Δy has to be ensured when the data voltage applied to the pixel is changed by an amount of "Δx." Thus, the external compensation technique is to implement the same (or effectively the same) brightness by calculating "Δx" for each pixel and applying the same driving current to the OLED. Namely, the external compensation technique may be implemented to adjust the gray levels so that the pixels have the same or effectively the same brightness.

An analog-to-digital converter (ADC) for converting an analog input signal into a digital output signal is used to implement the external compensation technique. The ADC may be embedded in a driver integrated circuit (IC) and may be connected to the pixel through a sensing channel. The ADC receives an analog sensing value indicating the electrical characteristics of the pixel through the sensing channel and compares the analog sensing value with an internally subdivided reference voltage to convert the analog sensing value into a digital sensing value.

One ADC may be assigned to a plurality of sensing channels. In this instance, one ADC may be commonly connected to the plurality of sensing channels. Because this method sequentially processes a plurality of analog sensing values input from the plurality of sensing channels by one ADC, an ADC operating at a high speed is necessary. Further, in the serial processing method, because the plurality of analog sensing values is sequentially processed in series by one ADC, it takes much time to perform an analog-to-digital conversion on the plurality of analog sensing values.

In order to reduce time required for the analog-to-digital conversion, a method has been considered to assign one ADC to each sensing channel and simultaneously process a plurality of analog sensing values input from the plurality of sensing channels by the plurality of ADCs. In such a parallel processing method, because each ADC processes only the analog sensing value input from one sensing channel, the ADCs do not need to operate at a high speed. Hence, the parallel processing method is advantageous to increase accuracy of the sensing. Further, in the parallel processing method, because the plurality of analog sensing values is simultaneously processed in parallel by the plurality of ADCs, there is an advantage that it takes a short time to perform the analog-to-digital conversion on the plurality of analog sensing values.

However, the parallel processing method requires the number of ADCs equals to the number of sensing channels, causing a problem of an increase in a chip size of the driver IC.

BRIEF SUMMARY

The present disclosure provides a driver integrated circuit and a display device including the same capable of minimizing an increase in a chip size of the driver IC due to an increase in the number of analog-to-digital converters resulting from a parallel processing method while reducing time required for an analog-to-digital conversion of a plurality of analog sensing values using a sensor employing the parallel processing method when an external compensation technique is implemented.

In one aspect, there is provided a driver integrated circuit including a data voltage generator including a digital-to-analog converter converting a digital signal into an analog signal, the data voltage generator configured to generate an analog data voltage in a display drive operation and apply the analog data voltage to pixels of a display panel; a sensor connected to a sensing channel connected to the pixels of the display panel, the sensor configured to share the digital-to-analog converter with the data voltage generator, convert an analog sensing voltage indicating electrical characteristics of the pixels input from the sensing channel into digital sensing data in a sensing drive operation, and output the digital sensing data; and switching elements configured to selectively operate in the display drive operation and the sensing drive operation.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIG. 12 illustrates an operation state of switches included in a driver IC of FIG. 11 in a display drive operation and a sensing drive operation;

FIG. 16 illustrates an operation state of switches included in a driver IC of FIG. 15 in a display drive operation and a sensing drive operation;

DETAILED DESCRIPTION

Figure 1:
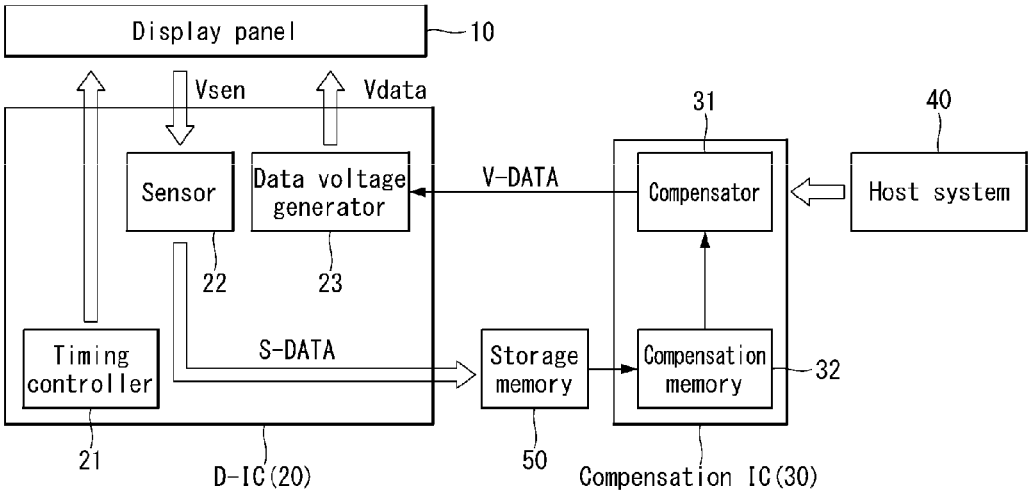
FIG. 1 is a block diagram of an electroluminescent display for external compensation according to an example embodiment.

Reference will now be made in detail to embodiments of the present disclosure, examples of which are illustrated in the accompanying drawings. However, the present disclosure is not limited to embodiments disclosed below, and may be implemented in various forms. These embodiments are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing embodiments of the present disclosure are merely exemplary, and the present disclosure is not limited thereto unless specified as such. Like reference numerals designate like elements throughout. In the following description, when a detailed description of certain functions or configurations related to this document that may unnecessarily cloud the gist of the disclosure have been omitted.

In the present disclosure, when the terms "include," "have," "comprised of," etc. are used, other components may be added unless "~only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above," "under or below," "next to" another structure, this description should be construed as including a case in which the structures directly contact each other as well as a case in which a third structure is disposed therebetween.

The terms "first," "second," etc. may be used to describe various components, but the components are not limited by such terms. The terms are used only for the purpose of distinguishing one component from other components. For example, a first component may be designated as a second component, and vice versa, without departing from the scope of the present disclosure.

The features of various embodiments of the present disclosure can be partially combined or entirely combined with each other, and can be technically interlocking-driven in various ways. The embodiments can be independently implemented, or can be implemented in conjunction with each other.

Various embodiments of the present disclosure will be described in detail below with reference to the accompanying drawings. In the following embodiments, an electroluminescent display will be described focusing on an organic light emitting diode (OLED) display including an organic light emitting material. However, it should be noted that embodiments of the present disclosure are not limited to the OLED display, and may be applied to an inorganic light emitting display including an inorganic light emitting material. Further, it should be noted that embodiments of the present disclosure may be applied not only to an electroluminescent display but also to a flat panel display such as a liquid crystal display, a plasma display, and an electrophoresis display.

Figure 2:
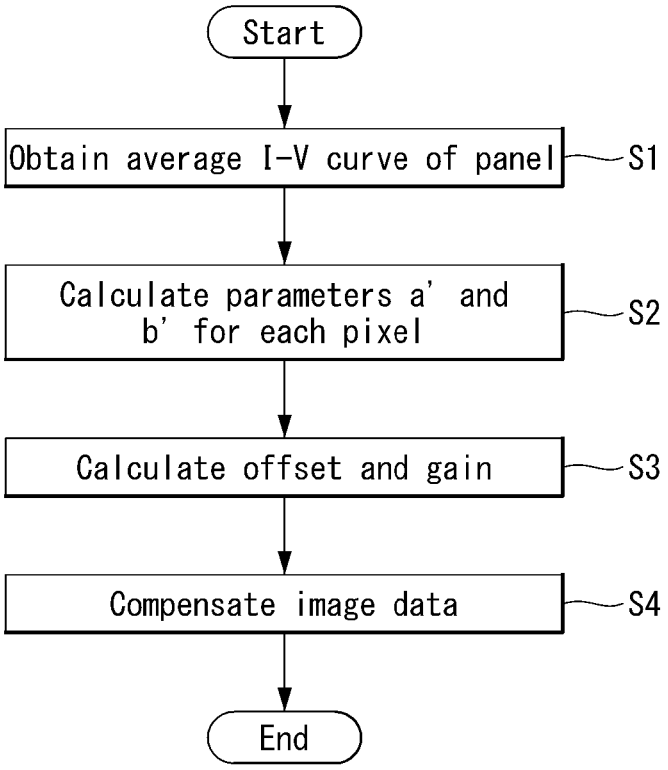
FIG. 2 is a flow chart illustrating an external compensation method according to an example embodiment.
Figure 3A:
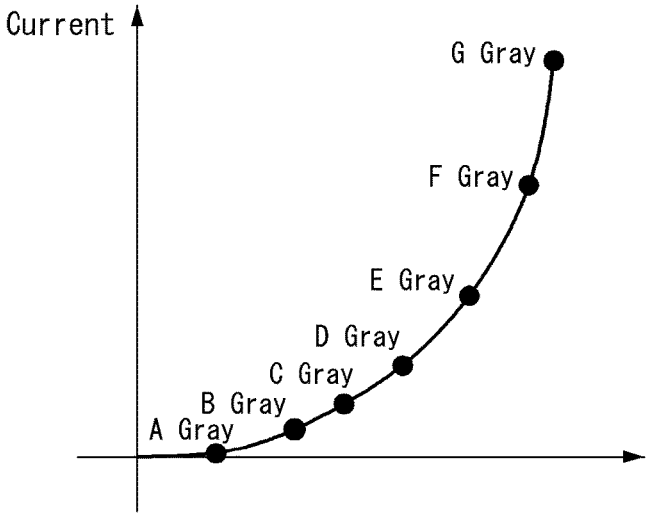
FIG. 3A illustrates that a reference curve equation is obtained in an external compensation method of FIG. 2.
Figure 3B:
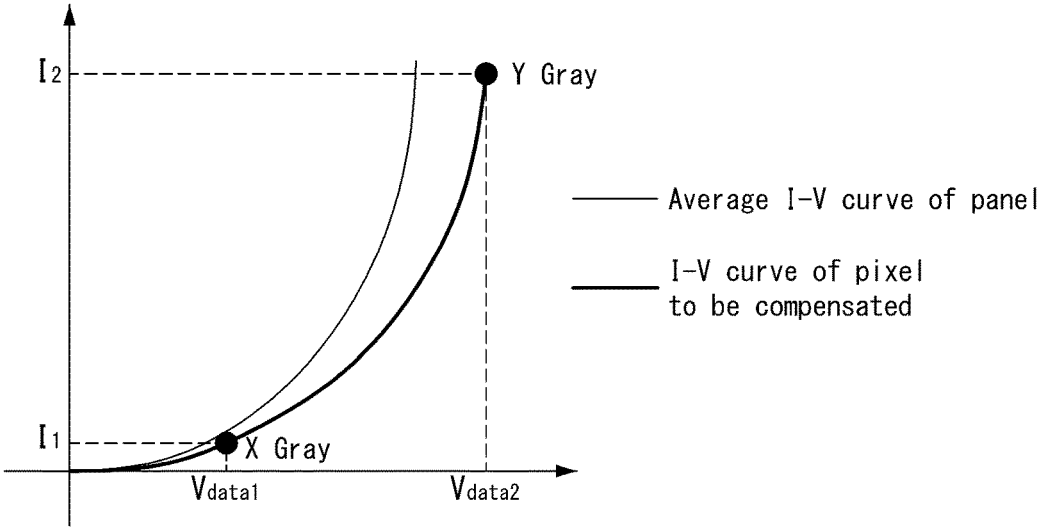
FIG. 3B illustrates an average I-V curve of a display panel and an I-V curve of a pixel to be compensated in an external compensation method of FIG. 2.
Figure 3C:
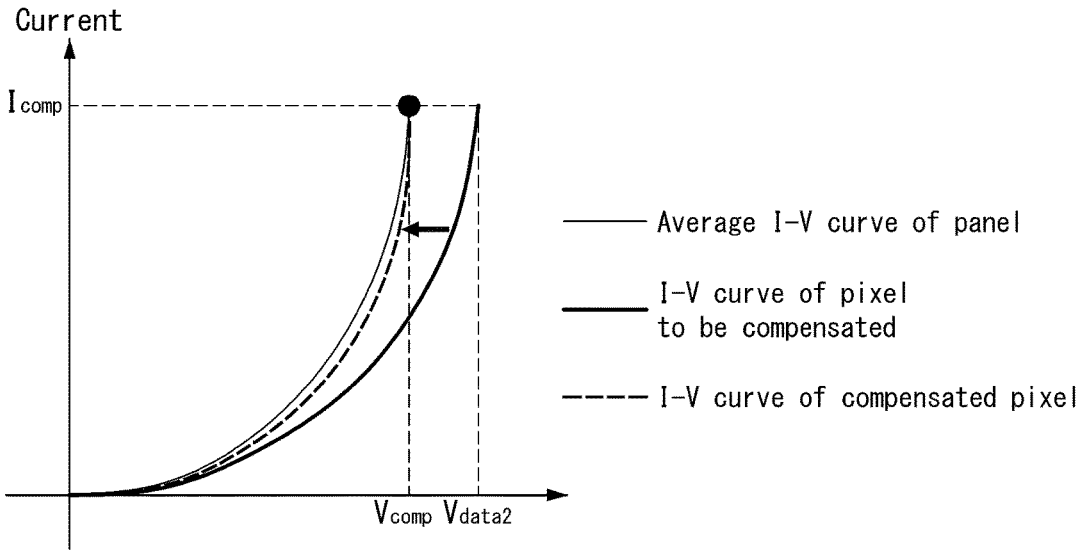
FIG. 3C illustrates an average I-V curve of a display panel, an I-V curve of a pixel to be compensated, and an I-V curve of a compensated pixel in an external compensation method of FIG. 2.

FIG. 1 is a block diagram of an electroluminescent display for external compensation according to an example embodiment. FIG. 2 is a flow chart illustrating an external compensation method according to an example embodiment. FIG. 3A illustrates that a reference curve equation is obtained in the external compensation method of FIG. 2. FIG. 3B illustrates an average I-V curve of a display panel and an I-V curve of a pixel to be compensated in the external compensation method of FIG. 2. FIG. 3C illustrates an average I-V curve of a display panel, an I-V curve of a pixel to be compensated, and an I-V curve of a compensated pixel in the external compensation method of FIG. 2.

Referring to FIG. 1, an electroluminescent display according to an example embodiment may include a display panel 10, a driver IC (or referred to as "D-IC") 20, a compensation IC 30, a host system 40, and a storage memory 50.

The display panel 10 includes a plurality of pixels and a plurality of signal lines. The signal lines may include data lines for supplying data signals (e.g., an analog data voltage Vdata) to the pixels and gate lines for supplying a scan control signal to the pixels. The signal lines may further include sensing lines that are used to sense electrical characteristics of the pixels. However, the sensing lines may be omitted depending on a circuit configuration of the pixel. In this instance, the electrical characteristics of the pixels may be sensed through the data lines.

The pixels of the display panel 10 are disposed in a matrix to form a pixel array. Each pixel may be connected to one of the data lines, one of the sensing lines, and at least one of the gate lines. Each pixel is configured to receive a high potential pixel power and a low potential pixel power from a power source or a power generator. To this end, the power generator may supply the high potential pixel power to the pixel through a high potential pixel power line or a pad and may supply the low potential pixel power to the pixel through a low potential pixel power line or a pad.

The display panel 10 may include a gate driver circuit for driving the gate lines. Shift registers constituting the gate driver circuit may be manufactured in an integrated circuit (IC) form and may be connected to the display panel 10. Further, the shift registers may be directly formed in a non-display area (i.e., a bezel area) outside the pixel array of the display panel 10 through a thin film transistor (TFT) process of a gate-in panel (GIP) manner, in order to reduce the manufacturing cost.

The driver IC 20 may include a timing controller 21, a sensor 22, and a data voltage generator 23. However, embodiments are not limited thereto.

The timing controller 21 may generate a gate timing control signal for controlling operation timing of the gate driver circuit and a data timing control signal for controlling operation timing of the data voltage generator 23 based on timing signals, for example, a vertical sync signal Vsync, a horizontal sync signal Hsync, a dot clock signal DCLK, and a data enable signal DE received from the host system 40.

The data timing control signal may include a source start pulse, a source sampling clock, and a source output enable signal, and the like, but is not limited thereto. The source start pulse controls a start time of data sampling of the data voltage generator 23. The source sampling clock is a clock signal that controls the sampling timing of data based on a rising edge or a falling edge thereof. The source output enable signal controls output timing of the data voltage generator 23.

The gate timing control signal may include a gate start pulse, a gate shift clock, and the like, but is not limited thereto. The gate start pulse is applied to a gate stage generating a first output and activates an operation of the gate stage. The gate shift clock is a clock signal that is commonly input to gate stages and shifts the gate start pulse.

The timing controller 21 may be configured so that a sensing drive operation and a display drive operation are separately performed in accordance with a particular control sequence. The sensing drive operation is an operation of converting a result (i.e., an analog sensing voltage Vsen) of sensing electrical characteristics of the pixels into digital sensing data S-DATA and updating a compensation value for compensating for changes in the electrical characteristics of the pixels based on the digital sensing data S-DATA. The display drive operation is an operation of modulating digital image data based on the updated compensation value, converting modulated digital image data V-DATA to be input to the pixels into an analog data voltage Vdata, and applying the analog data voltage Vdata to the pixels to display an input image on the pixels.

The timing controller 21 may differently generate timing control signals for the display drive and timing control signals for the sensing drive. However, embodiments are not limited thereto. The sensing drive operation may be performed in a vertical blanking interval during the display drive operation, in a power-on sequence interval before the beginning of the display drive operation, or in a power-off sequence interval after the end of the display drive operation under the control of the timing controller 21. However, embodiments are not limited thereto. For example, the sensing drive operation may be performed in a vertical active period during the display drive operation.

The vertical blanking interval is time, for which input digital image data is not written, and is arranged between vertical active periods in which input digital image data of one frame is written. The power-on sequence interval is a transient time between the turn-on of driving power and the beginning of image display. The power-off sequence interval is a transient time between the end of image display and the turn-off of driving power.

The timing controller 11 may detect a standby mode, a sleep mode, a low power mode, etc. in accordance with a particular sensing process and may control all of operations for the sensing drive. For example, the sensing drive operation may be performed in a state (e.g., the standby mode, the sleep mode, the low power mode, etc.) where only a screen of a display device is turned off while the system power is being applied. However, embodiments are not limited thereto.

The data voltage generator 23 includes a digital-to-analog converter (DAC) converting a digital signal into an analog signal. The data voltage generator 23 generates an analog data voltage and applies the analog data voltage to the pixels of the display panel 10 in the display drive operation. To this end, the data voltage generator 23 may convert digital image data V-DATA modulated by the compensation IC 30 into an analog gamma voltage and then output the analog gamma voltage to the data lines.

In the sensing drive operation, the sensor 22 may sense electrical characteristics of the pixels (for example, electrical characteristics of driving elements and/or light emitting elements included in the pixels) through the sensing lines. The sensor 22 may include a known voltage sensing unit or a known current sensing unit. The voltage sensing unit may sense a voltage charged to a specific node of the pixel as an analog sensing voltage Vsen in accordance with particular sensing conditions. The current sensing unit may directly sense a current flowing in a specific node of the pixel in accordance with particular sensing conditions and obtain an analog sensing voltage Vsen.

In order to reduce time required to convert a result (i.e., the analog sensing voltage Vsen) of sensing electrical characteristics of the pixels into the digital sensing data S-DATA, the sensor 22 includes an analog-to-digital converter (ADC) assigned to each sensing channel. The sensor 22 converts the analog sensing voltage Vsen into digital sensing data through a parallel processing method. Because a plurality of analog sensing values is simultaneously processed in parallel by the plurality of ADCs, it takes a short time to perform an analog-to-digital conversion on the plurality of analog sensing values. Because each ADC processes only an analog sensing value input from one sensing channel, the ADCs do not need to operate at a high speed. A sampling rate of the ADC and the accuracy of the sensing are in a trade-off relationship. The ADC according to the parallel processing method is more advantageous to increase the accuracy of the sensing than a high-speed ADC used in a serial processing method. The sensor 22 may include a successive approximation register (SAR) type ADC as an example of the ADC according to the parallel processing method, but is not limited thereto.

Because the sensor 22 employing the parallel processing method requires the ADCs equal to the number of sensing channels, a chip size of the driver IC 20 may increase. The embodiment includes a method of sharing a circuit element between the sensor 22 and the data voltage generator 23 with each other, so as to reduce the chip size of the driver IC 20. More specifically, the ADC included in the sensor 22 requires a DAC capable of generating a reference voltage, and the data voltage generator 23 also requires a DAC capable of converting digital image data to be input to the pixels into the analog data voltage. Thus, when the sensor 22 and the data voltage generator 23 share the DAC with each other, the number of DACs may decrease to one half. The sensor 22 and the data voltage generator 23 may further share a buffer with each other. However, the sensor 22 may not include the buffer so as to prevent an increase in power consumption resulting from a buffer operation. Embodiments describe the SAR type ADC as an example of the ADC sharing the DAC with the data voltage generator 23, but are not limited to the SAR type ADC. In embodiments disclosed herein, because the sensor 22 and the data voltage generator 23 share the DAC with each other, the SAR type ADC may be replaced by other ADCs each including the DAC.

In the sensing drive operation, the ADC included in the sensor 22 converts the analog sensing voltage Vsen into the digital sensing data S-DATA in accordance with the parallel processing method and then supplies the digital sensing data S-DATA to the storage memory 50.

In the sensing drive operation, the storage memory 50 stores the digital sensing data S-DATA input from the sensor 22. The storage memory 50 may be implemented as a flash memory, but is not limited thereto.

In the display drive operation, the compensation IC 30 calculates an offset and a gain for each pixel based on the digital sensing data S-DATA read from the storage memory 50. The compensation IC 30 modulates (or corrects) digital image data to be input to the pixels depending on the calculated offset and gain, and supplies the modulated digital image data V-DATA to the driver IC 20. To this end, the compensation IC 30 may include a compensator 31 and a compensation memory 32.

The compensation memory 32 allows access to the digital sensing data S-DATA read from the storage memory 50 to the compensator 31. The compensation memory 32 may be a random access memory (RAM), for example, a double data rate synchronous dynamic RAM (DDR SDRAM), but is not limited thereto.

As shown in FIGS. 2 to 3C, the compensator 31 may include a compensation algorithm that performs a compensation operation so that a current (I)-voltage (V) curve of a pixel to be compensated coincides with an average I-V curve. The average I-V curve may be obtained through a plurality of sensing operations.

More specifically, as shown in FIGS. 2 and 3A, the compensator 31 performs the sensing of a plurality of gray levels (for example, a total of seven gray levels A to G) and then obtains the following Equation 2 corresponding to the average I-V curve through a known least square method in step S1.

$$I=a(V_{data}-b) \qquad \text{Equation 2:}$$

where "a" is electron mobility of a driving TFT, "b" is a threshold voltage of the driving TFT, and "c" is a physical property value of the driving TFT.

As shown in FIGS. 2 and 3B, the compensator 31 calculates parameter values a' and b' of a previously sensed pixel based on current values I1 and I—2 and gray values (gray levels X and Y) (i.e., data voltage values Vdata1 and Vdata2 of digital level) measured at two points in step S2.

$$I_1=a'(V_{data1}-b')$$

$$I_2=a'(V_{data2}-b') \qquad \text{Equation 3:}$$

The compensator 31 may calculate the parameter values a' and b' of the previously sensed pixel using a quadratic equation in the above Equation 3.

As shown in FIGS. 2 and 3C, the compensator 31 may calculate an offset and a gain for causing the I-V curve of the pixel to be compensated to coincide with the average I-V curve in step S3. The offset and the gain of the compensated pixel are expressed by Equation 4.

$$\text{Vcomp}(a/a')^{1/c}\times V_{data}+(b'-b(a/a')^{1/c}) \qquad \text{Equation 4:}$$

where "Vcomp" is a compensation voltage. In Equation 4, the term $(a/a')^{1/c}$ is the gain portion of the compensation voltage Vcomp and the term $(b'-b(a/a')^{1/c})$ is the offset (portion of the compensation voltage.

The compensator 31 corrects digital image data to be input to the previously sensed pixel so that the digital image data corresponds to the compensation voltage Vcomp, in step S4.

The host system 40 may supply digital image data to be input to the pixels to the compensation IC 30. The host system 40 may further supply user input information, for example, digital brightness information to the compensation IC 30. The host system 40 may be implemented as an application processor.

Figure 4:
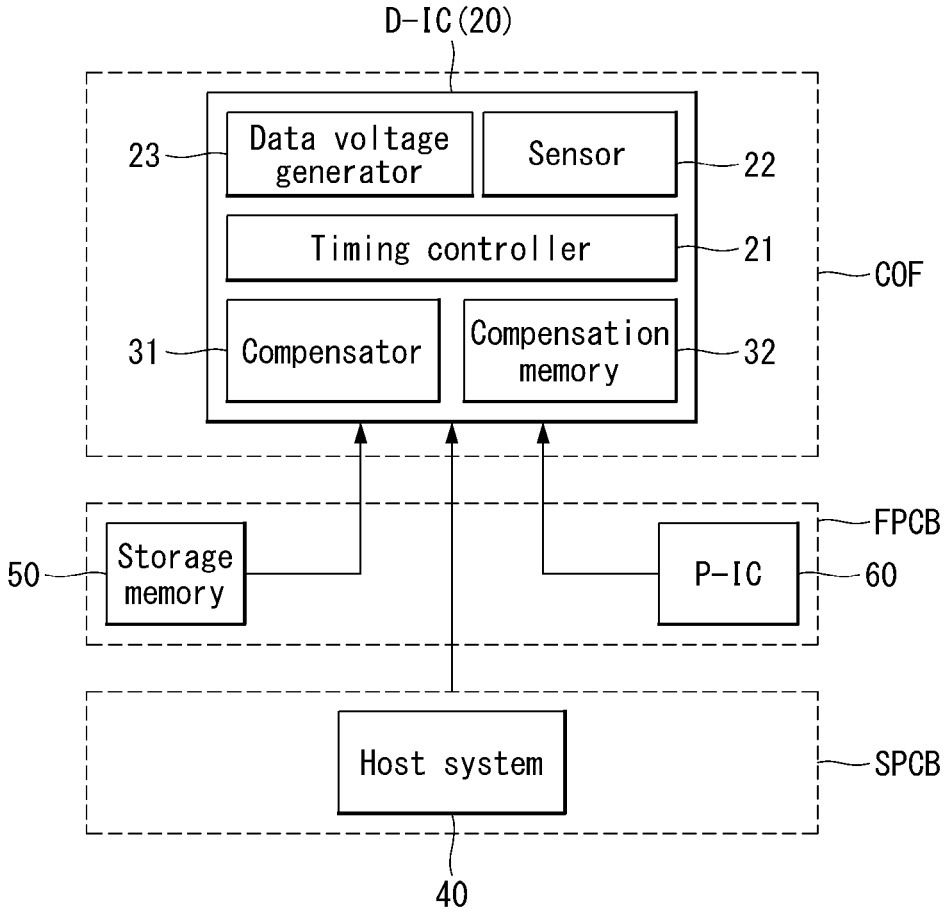
FIGS. 4 to 6 illustrate various examples of an external compensation module.
Figure 5:
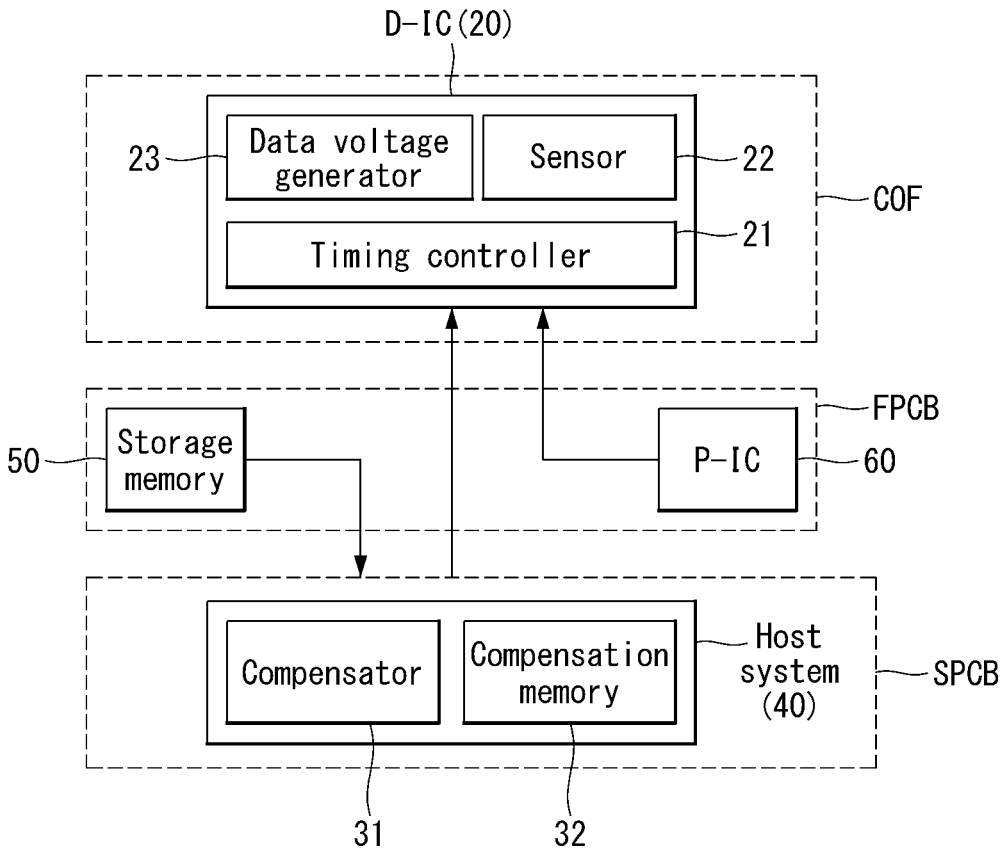
Figure 6:
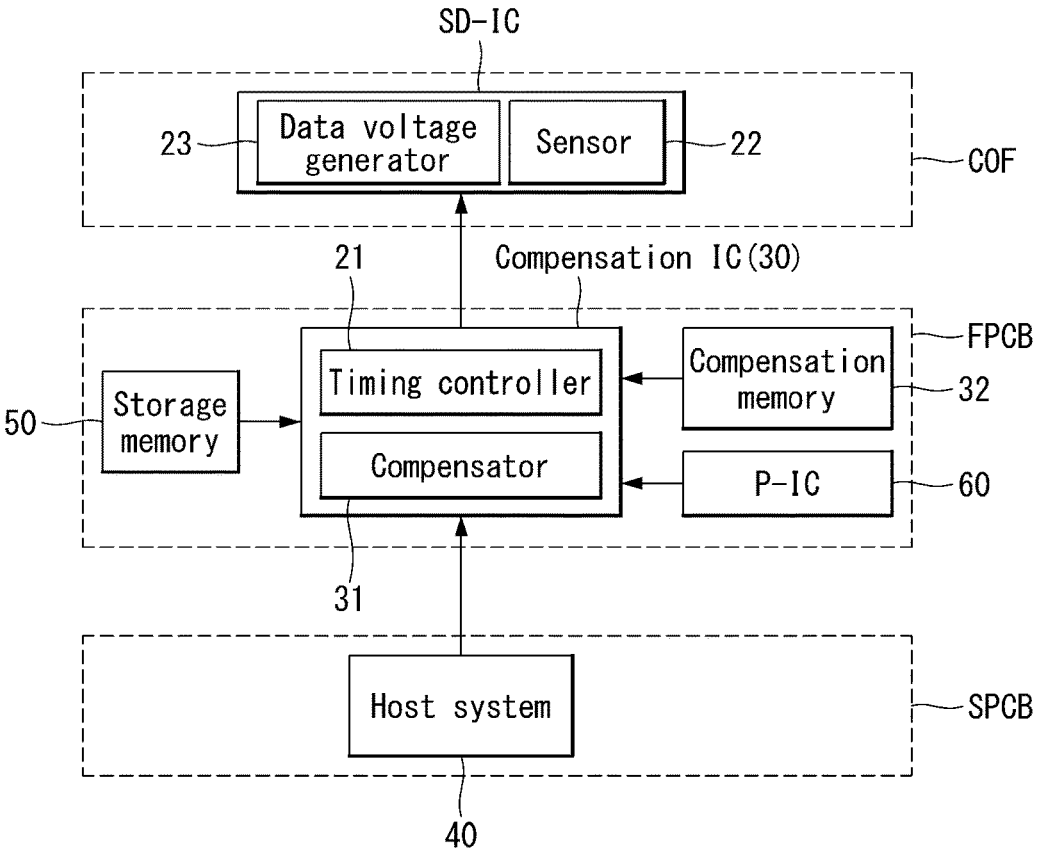

FIGS. 4 to 6 illustrate various examples of an external compensation module.

Referring to FIG. 4, the electroluminescent display according to the embodiment may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an external compensation module.

The driver IC (D-IC) 20 may further include a compensator 31 and a compensation memory 32 in addition to a timing controller 21, a sensor 22, and a data voltage generator 23. The external compensation module is implemented by combining the driver IC (D-IC) 20 and a compensation IC 30 (see FIG. 1) into one chip. The power IC (P-IC) 60 generates various driving powers required to operate the external compensation module.

Referring to FIG. 5, the electroluminescent display according to the embodiment may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an external compensation module.

The external compensation module of FIG. 5 is different from the external compensation module of FIG. 4 in that a compensator 31 and a compensation memory 32 are mounted on the host system 40 without being mounted on the driver IC 20. The external compensation module of FIG. 5 is implemented by integrating a compensation IC 30 (see FIG. 1) into the host system 40 and is meaningful in that the configuration of the driver IC 20 can be simplified.

Referring to FIG. 6, the electroluminescent display according to the embodiment may include a source driver IC SD-IC mounted on a chip-on film (COF), a storage memory 50, a compensation IC 30, a compensation memory 32, and a power IC (or referred to as "P-IC") 60 mounted on a flexible printed circuit board (FPCB), and a host system 40 mounted on a system printed circuit board (SPCB), in order to implement an external compensation module.

The external compensation module of FIG. 6 is different from the external compensation modules of FIGS. 4 and 5 in that the configuration of the source driver IC SD-IC is further simplified by mounting only a data voltage generator 23 and a sensor 22 in the source driver IC SD-IC, and a timing controller 21 and the compensation memory 32 are mounted in the compensation IC 30 that is separately manufactured. The external compensation module of FIG. 6 can easily perform an uploading and downloading operation of a compensation parameter by together mounting the compensation IC 30, the storage memory 50, and the compensation memory 32 on the flexible printed circuit board.

Figure 7:
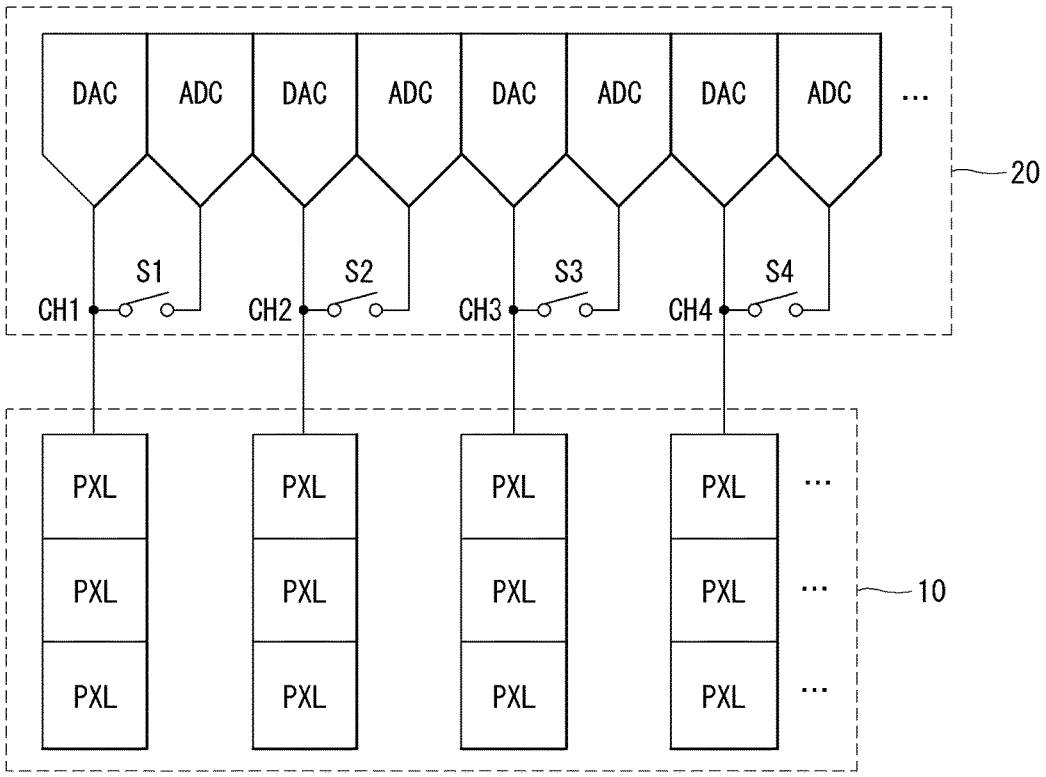
FIG. 7 illustrates an example of a sensor in which an analog-to-digital converter (ADC) is assigned to each sensing channel.
Figure 8:
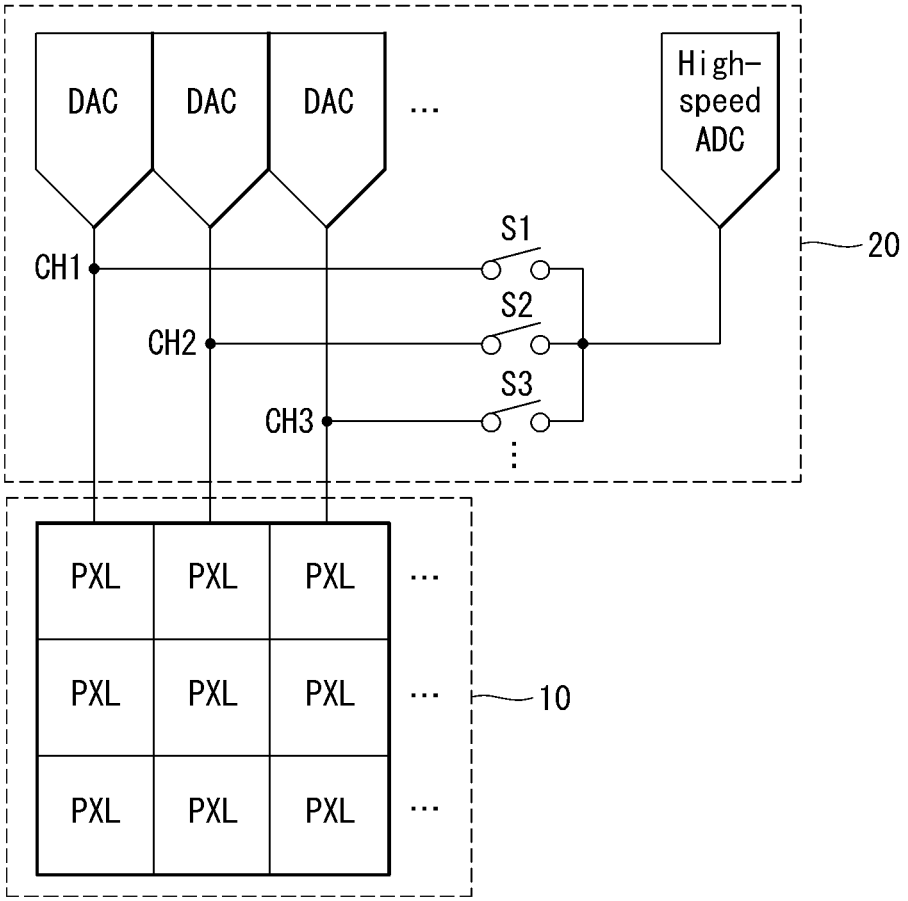
FIG. 8 illustrates another example of a sensor in which a high-speed ADC is assigned every a plurality of sensing channels.

FIG. 7 illustrates an example of a sensor in which an ADC is assigned to each sensing channel. FIG. 8 illustrates another example of a sensor in which a high-speed ADC is assigned every a plurality of sensing channels.

Referring to FIG. 7, the driver IC 20 may be connected to pixels PXL of the display panel 10 through sensing channels CH1, CH2, CH3 and CH4. In the driver IC 20, a plurality of DACs included in the data voltage generator 23 may be respectively connected to the sensing channels CH1, CH2, CH3 and CH4, and a plurality of ADCs included in the sensor 22 may be respectively connected to the sensing channels CH1, CH2, CH3 and CH4 through switches S1, S2, S3 and S4. The ADCs included in the sensor 22 are respectively connected to the sensing channels CH1, CH2, CH3 and CH4 and convert an analog sensing voltage into digital sensing data through a parallel processing method. Because data of one sensing channel is processed by one ADC in the parallel processing method, the parallel processing method may use an ADC of a relatively slower speed than a serial processing method of FIG. 8. However, the parallel processing method has a disadvantage in that a circuit area of the driver IC 20 increases due to the plurality of ADCs.

In the serial processing method of FIG. 8, a single ADC included in the sensor 22 is commonly connected to sensing channels CH1, CH2, CH3 and CH4 through switches S1, S2, S3 and S4. Because data of the plurality of sensing channels is sequentially processed by one ADC in the serial processing method, the serial processing method has disadvantages in that a process time increases and a high-speed ADC is required.

Hereinafter, embodiments describe methods of reducing a chip size of the driver IC 20 implemented according to the parallel processing method of FIG. 7.

Figure 9:
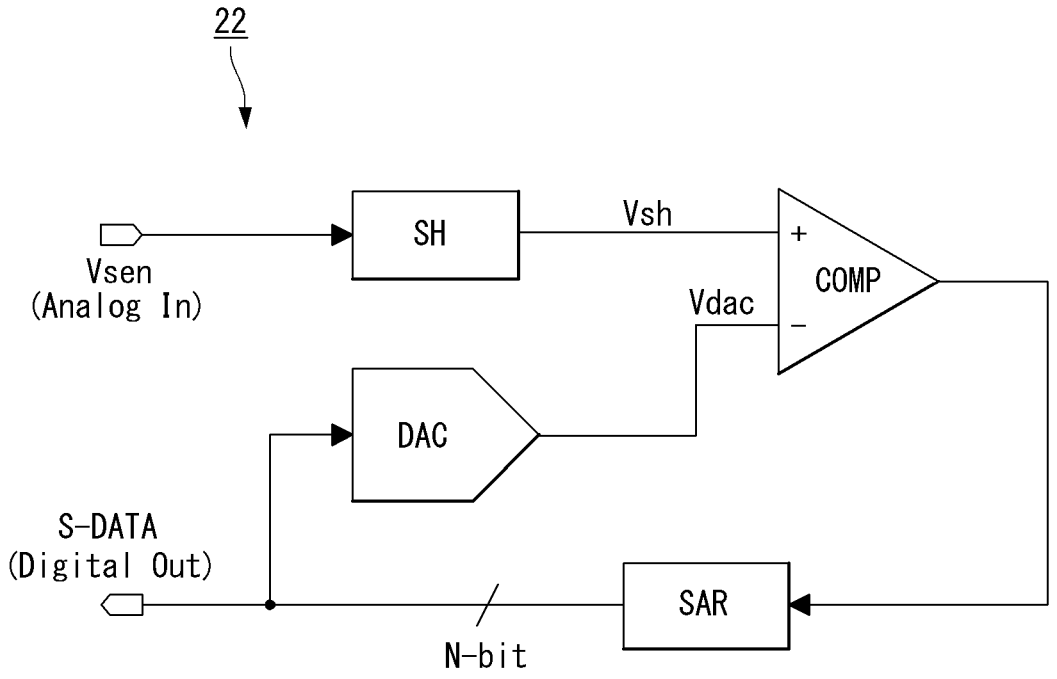
FIG. 9 illustrates a SAR type ADC as an example of an ADC including a DAC included in a sensor for implementing a parallel processing method.

FIG. 9 illustrates a SAR type ADC as an example of an ADC including a DAC included in the sensor for implementing the parallel processing method.

Referring to FIG. 9, a successive approximation register (SAR) type ADC included in the sensor 22 converts a sensing voltage Vsen, which is an analog input signal, into digital sensing data S-DATA which is a digital output signal. To this end, the SAR type ADC may include a sample and hold circuit SH ("sample and hold SH") for sampling the sensing voltage Vsen and outputting a sampling voltage Vsh, a DAC for converting a value of a control register SAR into an analog reference voltage Vdac and outputting the analog reference voltage Vdac, a comparator COMP for comparing the sampling voltage Vsh input to a first input terminal (+) with the analog reference voltage Vdac input to a second input terminal (−), and the control register SAR for determining digital output bit values in order from most significant bit (MSB) in response to a comparison result of the comparator COMP.

The control register SAR has a size corresponding to the number of bits (for example, N bits) of digital data to be converted. An operation of the SAR type ADC is described below.

In a first stage, the SAR type ADC sets a variable "c" for counting bits of the control register SAR to "1" and initializes the control register SAR to "0." Next, in a second stage, the SAR type ADC assigns "1" (SAR=1000 . . . 000) to Ith-bit of the control register SAR. Next, in a third stage, when the DAC of the SAR type ADC performs a digital-to-analog conversion on a value of the control register SAR to generate the reference voltage Vdac, the comparator COMP of the SAR type ADC compares the sensing voltage Vsen input to the sample and hold SH with the reference voltage Vdac input to the DAC. When the sensing voltage Vsen is less than the reference voltage Vdac as a result of the comparison, the Ith-bit of the control register SAR is cleared to "0" (SAR=0000 . . . 000). On the other hand, when the sensing voltage Vsen is equal to or greater than the reference voltage Vdac as a result of the comparison, the value of the control register SAR is maintained as it is. In a next stage, the variable "c" for counting bits of the control register SAR and a variable "N" indicating a size of the control register SAR are compared with each other. When the variable "c" is less than the variable "N" indicating the size of the control register SAR as a result of the comparison, the operation of the SAR type ADC is feedbacked to the above second stage. On the other hand, when the variable "c" is equal to or greater than the variable "N," the comparison operation of the comparator COMP ends. As described above, the comparator COMP outputs a value of "1" when the analog input signal Vsen is equal to or greater than the value of the control register SAR, and outputs a value of "0" when the analog input signal Vsen is less than the value of the control register SAR. A value finally stored in the control register SAR after the above process is repeatedly performed on Nth-bit of the control register SAR is an equivalent digital output signal S-DATA obtained by digitally converting the analog input signal Vsen.

Figure 10:
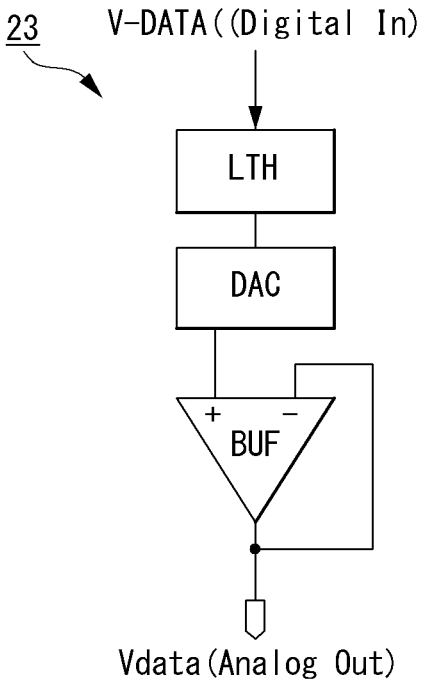
FIG. 10 illustrates configuration of a data voltage generator including a DAC for converting digital image data into an analog data voltage.

FIG. 10 illustrates configuration of the data voltage generator including a DAC for converting digital image data into an analog data voltage.

Referring to FIG. 10, the data voltage generator 23 includes a latch LTH, a DAC, and a buffer BUF.

The latch LTH latches digital image data V-DATA to be input to the pixels. The digital image data V-DATA may be digital image data V-DATA modulated through a correction operation of the above-described compensation IC.

The DAC converts the digital image data V-DATA latched by the latch LTH into an analog data voltage Vdata.

The buffer BUF stabilizes the analog data voltage Vdata input from the DAC and outputs the stabilized analog data voltage Vdata.

Figure 11:
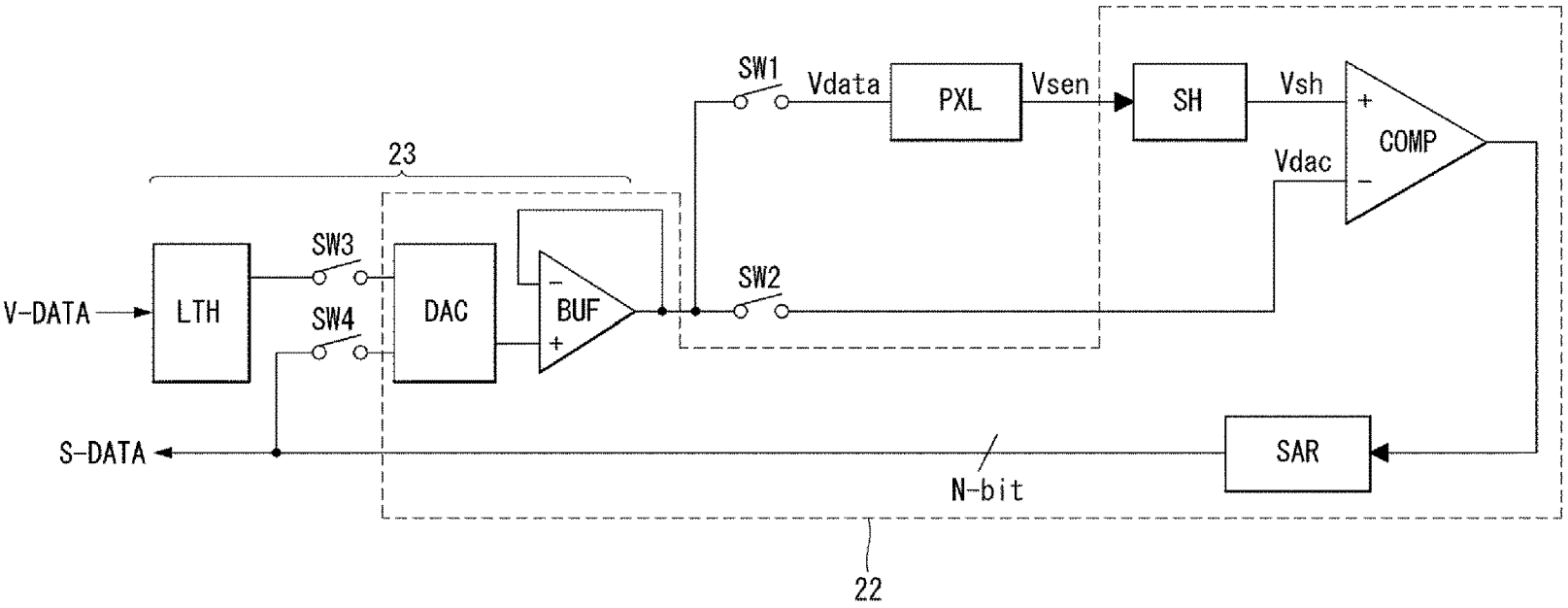
FIG. 11 illustrates configuration of a driver IC in which a sensor and a data voltage generator share a DAC with each other.
Figure 13:
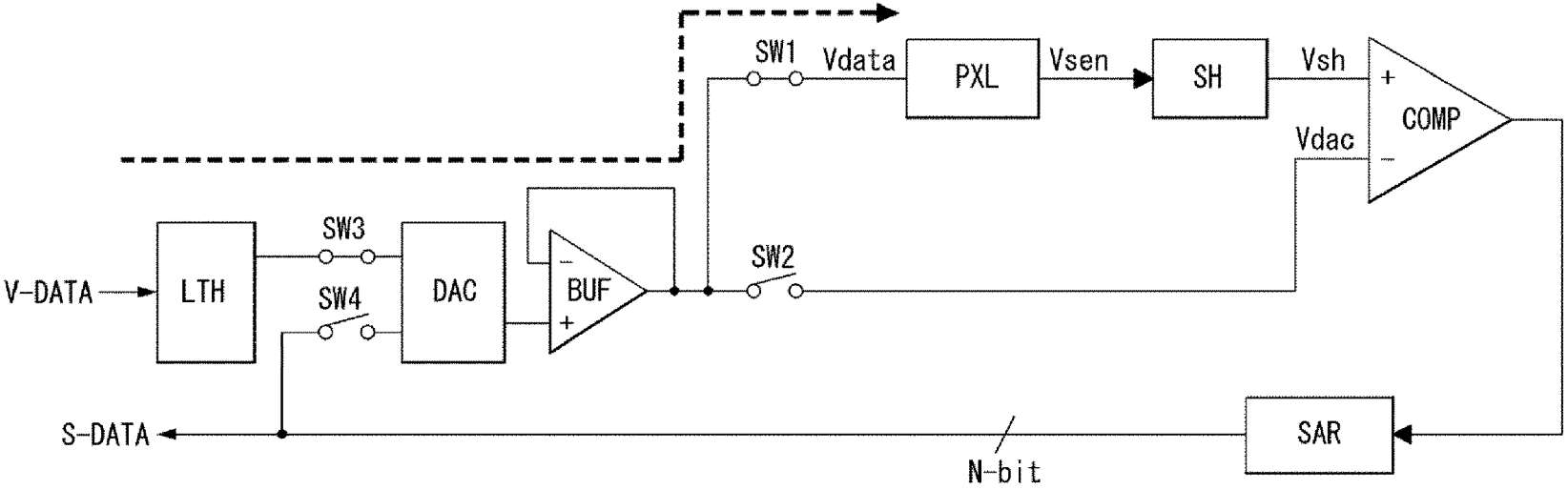
FIG. 13 illustrates an operation of a driver IC of FIG. 11 in a display drive operation.
Figure 14:
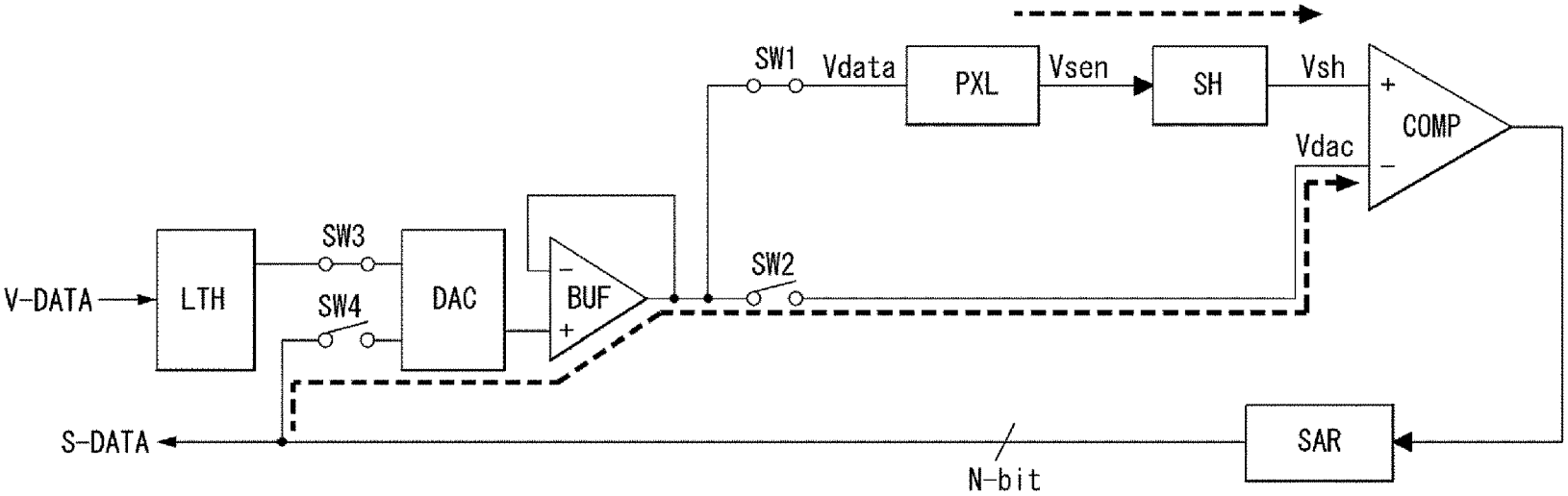
FIG. 14 illustrates an operation of a driver IC of FIG. 11 in a sensing drive operation.

FIG. 11 illustrates configuration of a driver IC in which a sensor and a data voltage generator share a DAC with each other. FIG. 12 illustrates an operation state of switches included in the driver IC of FIG. 11 in a display drive operation and a sensing drive operation. FIG. 13 illustrates an operation of the driver IC of FIG. 11 in a display drive operation. FIG. 14 illustrates an operation of the driver IC of FIG. 11 in a sensing drive operation.

As shown in FIG. 11, a driver IC 20 according to one embodiment includes a sensor 22 and a data voltage generator 23 that share a DAC and a buffer BUF with each other, and switching elements SW1, SW2, SW3 and SW4, each of which selectively operates in a display drive operation and a sensing drive operation.

Configuration of the data voltage generator 23 shown in FIG. 11 is substantially the same as configuration of the data voltage generator 23 shown in FIG. 10. The data voltage generator 23 includes a latch LTH latching digital image data V-DATA to be input; a DAC that is connected to the latch LTH through the third switching element SW3 among the switching elements SW1, SW2, SW3 and SW4 and converts the digital image data V-DATA latched by the latch LTH into an analog data voltage Vdata; and a buffer BUF that stabilizes the analog data voltage Vdata input from the DAC and then applies the stabilized analog data voltage Vdata to the pixel PXL through the first switching element SW1 among the switching elements SW1, SW2, SW3 and SW4.

An operation of the data voltage generator 23 is activated in the display drive operation and is inactivated in the sensing drive operation. Thus, as shown in FIG. 12, the first switching element SW1 and the third switching element SW3 are turned on in the display drive operation and are turned off in the sensing drive operation.

The sensor 22 may be implemented in substantially the same manner as an ADC (i.e., the SAR type ADC of FIG. 9) including a DAC used in the parallel processing method of FIG. 7. A SAR type ADC included in the sensor 22 shares the DAC and the buffer BUF with the data voltage generator 23 and is connected to each sensing channel connected to the pixels PXL. In the sensing drive operation, the SAR type ADC converts an analog sensing voltage Vsen indicating electrical characteristics of the pixels input from the sensing channel into digital sensing data S-DATA and outputs the digital sensing data S-DATA. The plurality of SAR type ADCs individually connected to the plurality of sensing channels simultaneously digitally processes a plurality of analog sensing values input from the plurality of sensing channels.

The SAR type ADC included in the sensor 22 includes a sample and hold circuit SH, a comparator COMP, a control register SAR, a DAC, and a buffer BUF, as described above with reference to FIG. 9. The DAC and the buffer BUF are shared by the sensor 22 and the data voltage generator 23 and thus contribute to a reduction in a chip size of the driver IC 20.

The sample and hold SH is connected to the sensing channel and samples the analog sensing voltage Vsen to output a sampling voltage Vsh. The comparator COMP includes a first input terminal (+) connected to the sample and hold SH and a second input terminal (−) connected to the buffer BUF through the second switching element SW2 among the switching elements SW1, SW2, SW3 and SW4. The comparator COMP compares the sampling voltage Vsh input to the first input terminal (+) with an analog reference voltage Vdac input to the second input terminal (−). The control register SAR is connected to an output terminal of the comparator COMP and determines digital output bit values in order from most significant bit (MSB) in response to a comparison result of the comparator COMP. The DAC is connected to the control register SAR through the fourth switching element SW4 among the switching elements SW1, SW2, SW3 and SW4 and converts a value of the control register SAR into the analog reference voltage Vdac. The buffer BUF stabilizes the analog reference voltage Vdac input from the DAC and outputs the stabilized analog reference voltage Vdac to the second input terminal (−) of the comparator COMP.

An operation of the SAR type ADC included in the sensor 22 is activated in the sensing drive operation and is inactivated in the display drive operation. Thus, as shown in FIG. 12, the second switching element SW2 and the fourth switching element SW4 are turned on in the sensing drive operation and are turned off in the display drive operation. An operation of the SAR type ADC included in the sensor 22 is substantially the same as the operation described with reference to FIG. 9.

Referring to FIG. 13, in the display drive operation, the latch LTH, the third switching element SW3, the DAC, the buffer BUF, and the first switching element SW1 of the driver IC 20 are activated. Hence, the analog data voltage Vdata corresponding to the digital image data V-DATA is applied to the pixel PXL.

Referring to FIG. 14, in the sensing drive operation, the sample and hold SH, the DAC, the buffer BUF, the second switching element SW2, the comparator COMP, the control register SAR, and the fourth switching element SW4 of the driver IC 20 are activated. Hence, the sensing voltage Vsen input from the pixel PXL is converted into the digital sensing data S-DATA.

Figure 15:
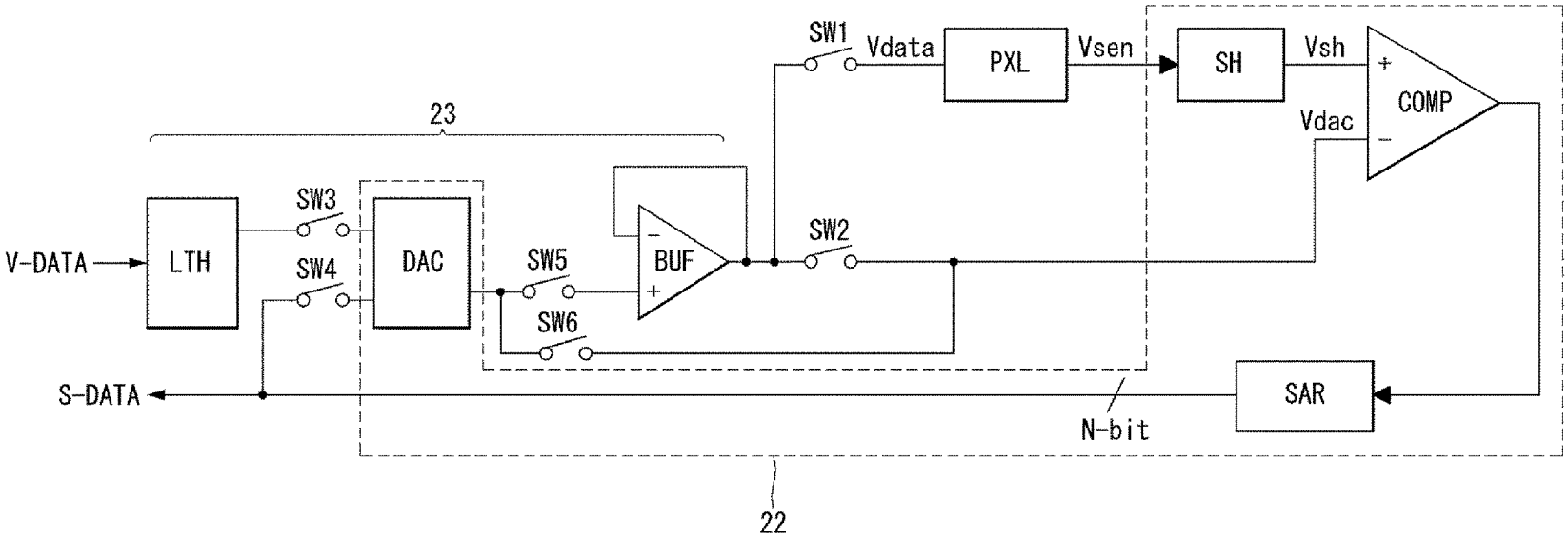
FIG. 15 illustrates another configuration of a driver IC in which a sensor and a data voltage generator share a DAC with each other.
Figure 17:
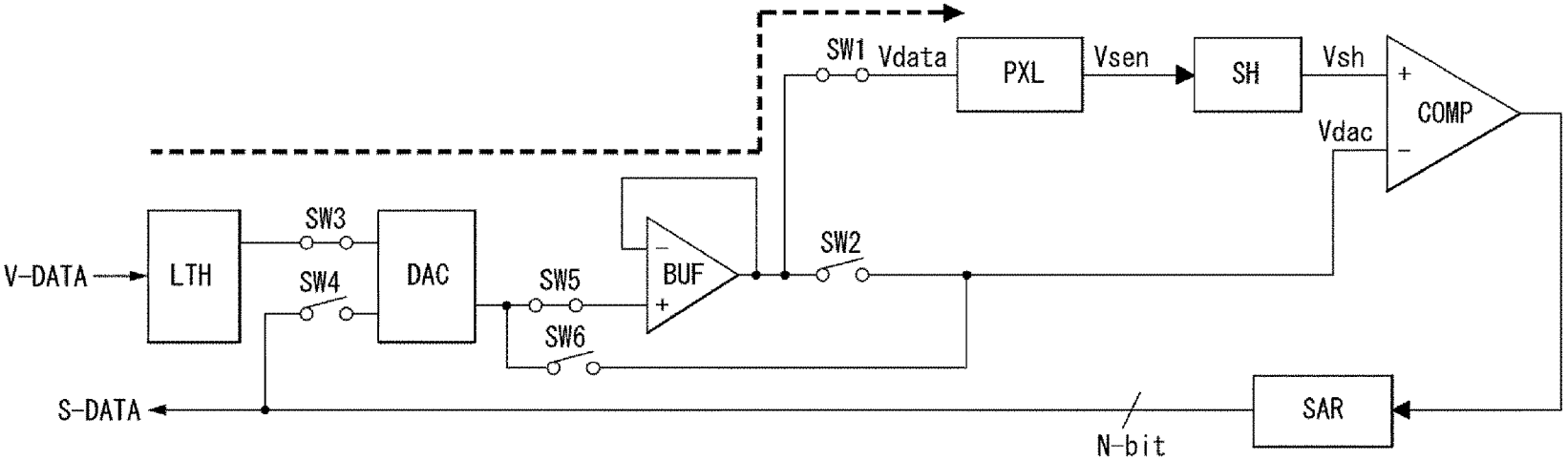
FIG. 17 illustrates an operation of a driver IC of FIG. 15 in a display drive operation.
Figure 18:
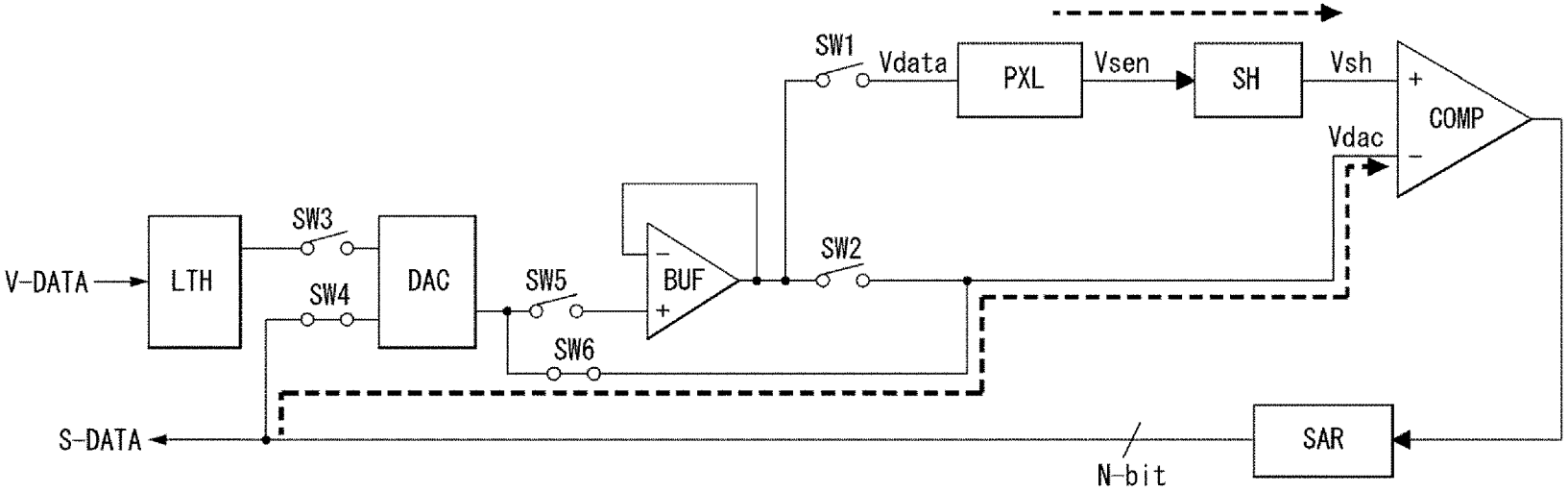
FIG. 18 illustrates an operation of a driver IC of FIG. 15 in a sensing drive operation.

FIG. 15 illustrates another configuration of a driver IC in which a sensor and a data voltage generator share a DAC with each other. FIG. 16 illustrates an operation state of switches included in the driver IC of FIG. 15 in a display drive operation and a sensing drive operation. FIG. 17 illustrates an operation of the driver IC of FIG. 15 in a display drive operation. FIG. 18 illustrates an operation of the driver IC of FIG. 15 in a sensing drive operation.

As shown in FIG. 15, a driver IC 20 according to another embodiment includes a sensor 22 and a data voltage generator 23 that share a DAC with each other, and switching elements SW1, SW2, SW3, SW4, SW5 and SW6, each of which selectively operates in a display drive operation and a sensing drive operation. The driver IC 20 of FIG. 15 is different from the driver IC 20 of FIG. 11 in that the sensor 22 does not include a buffer BUF. When the buffer BUF does not operate in the sensing drive operation as described above, it is effective to reduce power consumption.

Configuration of the data voltage generator 23 shown in FIG. 15 is substantially the same as configuration of the data voltage generator 23 shown in FIG. 10. The data voltage generator 23 includes a latch LTH latching digital image data V-DATA to be input; a DAC that is connected to the latch LTH through the third switching element SW3 among the switching elements SW1, SW2, SW3, SW4, SW5 and SW6 and converts the digital image data V-DATA latched by the latch LTH into an analog data voltage Vdata; and a buffer BUF that is connected to the DAC through the fifth switching element SW5 among the switching elements SW1, SW2, SW3, SW4, SW5 and SW6, stabilizes the analog data voltage Vdata input from the DAC, and applies the stabilized analog data voltage Vdata to the pixel PXL through the first switching element SW1 among the switching elements SW1, SW2, SW3, SW4, SW5 and SW6.

An operation of the data voltage generator 23 is activated in the display drive operation and is inactivated in the sensing drive operation. Thus, as shown in FIG. 16, the first switching element SW1, the third switching element SW3, and the fifth switching element SW5 are turned on in the display drive operation and are turned off in the sensing drive operation.

The sensor 22 may be implemented in substantially the same manner as an ADC (i.e., the SAR type ADC of FIG. 9) including a DAC used in the parallel processing method of FIG. 7. A SAR type ADC included in the sensor 22 shares the DAC with the data voltage generator 23 and is connected to each sensing channel connected to the pixels PXL. In the sensing drive operation, the SAR type ADC converts an analog sensing voltage Vsen of electrical characteristics of the pixels input from the sensing channel into digital sensing data S-DATA and outputs the digital sensing data S-DATA. The plurality of SAR type ADCs individually connected to the plurality of sensing channels simultaneously digitally processes a plurality of analog sensing values input from the plurality of sensing channels.

The SAR type ADC included in the sensor 22 includes a sample and hold SH, a comparator COMP, a control register SAR, and a DAC, as described above with reference to FIG. 9. The DAC is shared by the sensor 22 and the data voltage generator 23 and thus contributes to a reduction in a chip size of the driver IC 20.

The sample and hold SH is connected to the sensing channel and samples the analog sensing voltage Vsen to output a sampling voltage Vsh. The comparator COMP includes a first input terminal (+) connected to the sample and hold SH and a second input terminal (−) connected to the DAC through the sixth switching element SW6 among the switching elements SW1, SW2, SW3, SW4, SW5 and SW6. The comparator COMP compares the sampling voltage Vsh input to the first input terminal (+) with an analog reference voltage Vdac input to the second input terminal (−). The control register SAR is connected to an output terminal of the comparator COMP and determines digital output bit values in order from most significant bit (MSB) in response to a comparison result of the comparator COMP. The DAC is connected to the control register SAR through the fourth switching element SW4 among the switching elements SW1, SW2, SW3, SW4, SW5 and SW6 and converts a value of the control register SAR into the analog reference voltage Vdac.

An operation of the SAR type ADC included in the sensor 22 is activated in the sensing drive operation and is inactivated in the display drive operation. Thus, as shown in FIG. 16, the fourth switching element SW4 and the sixth switching element SW6 are turned on in the sensing drive operation and are turned off in the display drive operation. An operation of the SAR type ADC included in the sensor 22 is substantially the same as the operation described with reference to FIG. 9.

The second switching element SW2 among the switching elements SW1, SW2, SW3, SW4, SW5 and SW6 may be further connected between an output terminal of the buffer BUF and the second input terminal (−) of the comparator COMP. The second switching element SW2 is turned off in the display drive operation and the display drive operation. The second switching element SW2 may be omitted, and thus the output terminal of the buffer BUF and the second input terminal (−) of the comparator COMP may not be connected.

Referring to FIG. 17, in the display drive operation, the latch LTH, the third switching element SW3, the DAC, the buffer BUF, and the first switching element SW1 of the driver IC 20 are activated. Hence, the analog data voltage Vdata corresponding to the digital image data V-DATA is applied to the pixel PXL.

Referring to FIG. 18, in the sensing drive operation, the sample and hold SH, the DAC, the sixth switching element SW6, the comparator COMP, the control register SAR, and the fourth switching element SW4 of the driver IC 20 are activated. Hence, the sensing voltage Vsen input from the pixel PXL is converted into the digital sensing data S-DATA.

As described above, embodiments can reduce time required to perform the analog-to-digital conversion on the plurality of analog sensing values by employing the sensor according to the parallel processing method when an external compensation technique is implemented.

Further, embodiments can greatly increase the accuracy of the sensing by using the low-speed ADC according to the parallel processing method.

In particular, embodiments are designed so that the data voltage generator and the sensor of the driver IC share a portion of the circuit configuration with each other. Hence, embodiments can minimize an increase in the chip size of the driver IC resulting from an increase in the number of ADCs according to the parallel processing method.

The effects according to embodiments of the present disclosure are not limited by the contents exemplified above, and more various effects are included in the present disclosure.

Although various embodiments have been described with reference to a number of illustrative embodiments thereof, numerous other modifications and embodiments may be devised by those skilled in the art that will fall within the scope of the principles of this disclosure. In particular, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A driver integrated circuit comprising: a data voltage generator including a digital-to-analog converter converting a digital signal into an analog signal, the data voltage generator configured to generate an analog data voltage in a display drive operation and apply the analog data voltage to pixels of a display panel; a sensor connected to a sensing channel connected to the pixels of the display panel, the sensor configured to share the digital-to-analog converter with the data voltage generator, convert an analog sensing voltage input from the sensing channel, which indicates electrical characteristics of the pixels, into digital sensing data in a sensing drive operation, and output the digital sensing data; switching elements configured to switch between the display drive operation and the sensing drive operation; and wherein the sensor includes: a sample and hold circuit connected to the sensing channel, the sample and hold circuit configured to sample the analog sensing voltage and output a sampling voltage; a comparator including a first input terminal connected to the sample and hold circuit and a second input terminal connected to the buffer, the comparator configured to compare the sampling voltage input to the first input terminal with an analog reference voltage input to the second input terminal; a control register connected to an output terminal of the comparator and configured to determine a digital output bit value in response to a comparison result of the comparator; the digital-to-analog converter connected to the control register and configured to convert a value of the control register into the analog reference voltage; and the buffer configured to stabilize the analog reference voltage input from the digital-to-analog converter and output the stabilized analog reference voltage to the second input terminal of the comparator.

2. The driver integrated circuit of claim 1, wherein the sensor includes an analog-to-digital converter connected to each sensing channel connected to the pixels.

3. The driver integrated circuit of claim 2, wherein the sensor includes a successive approximation register (SAR) type analog-to-digital converter, and wherein a plurality of analog-to-digital converters respectively connected to a plurality of sensing channels simultaneously processes a plurality of analog sensing values input from the plurality of sensing channels.

4. The driver integrated circuit of claim 1, wherein the data voltage generator includes:

a latch configured to latch digital image data, the digital-to-analog converter electrically connected to the latch, and configured to convert the digital image data latched by the latch into the analog data voltage; and a buffer configured to stabilize the analog data voltage and apply the stabilized analog data voltage to a pixel of the pixels.

5. The driver integrated circuit of claim 4, wherein the switching elements include:

a third switching element connected between the latch and the digital-to-analog converter; and a first switching element connected between the buffer and the pixel.

6. The driver integrated circuit of claim 4, wherein the data voltage generator and the sensor further share the buffer with each other.

7. The driver integrated circuit of claim 1, wherein the switching elements include: a second switching element connected between the buffer and the second input terminal of the comparator; and a fourth switching element connected between the control register and the digital-to-analog converter.

8. The driver integrated circuit of claim 1, wherein the control register determines the digital output bit value in order from most significant bit (MLB) in response to the comparison result of the comparator.

9. The driver integrated circuit of claim 5, wherein in the display drive operation, the first switching element and the third switching element are turned on, and wherein in the sensing drive operation, the first switching element and the third switching element are turned off.

10. The driver integrated circuit of claim 7, wherein in the display drive operation, the second switching element and the fourth switching element are turned off, and wherein in the sensing drive operation, the second switching element and the fourth switching element are turned on.

11. The driver integrated circuit of claim 5, wherein the switching elements further include a fifth switching element connected between the digital-to-analog converter and the buffer.

12. The driver integrated circuit of claim 11, wherein the sensor includes:

a sample and hold circuit connected to the sensing channel, the sample and hold circuit configured to sample the analog sensing voltage and output a sampling voltage;

a comparator including a first input terminal connected to the sample and hold circuit and a second input terminal connected to the digital-to-analog converter, the comparator configured to compare the sampling voltage input to the first input terminal with an analog reference voltage input to the second input terminal;

a control register connected to an output terminal of the comparator and configured to determine a digital output bit value in response to a comparison result of the comparator; and the digital-to-analog converter connected to the control register, the digital-to-analog converter configured to convert a value of the control register into the analog reference voltage and output the analog reference voltage to the second input terminal of the comparator.

13. The driver integrated circuit of claim 12, wherein the switching elements further include:

a sixth switching element connected between the digital-to-analog converter and the second input terminal of the comparator; and a fourth switching element connected between the control register and the digital-to-analog converter.

14. The driver integrated circuit of claim 12, wherein the control register determines the digital output bit value in order from most significant bit (MLB) in response to the comparison result of the comparator.

15. The driver integrated circuit of claim 13, wherein in the display drive operation, the first switching element, the third switching element, and the fifth switching element are turned on, and the fourth switching element and the sixth switching element are turned off, and wherein in the sensing drive operation, the first switching element, the third switching element, and the fifth switching element are turned off, and the fourth switching element and the sixth switching element are turned on.

16. The driver integrated circuit of claim 12, wherein a second switching element of the switching elements is further connected between an output terminal of the buffer and the second input terminal of the comparator.

17. The driver integrated circuit of claim 16, wherein the second switching element is turned off in the display drive operation and the sensing drive operation.

18. A display device comprising: a display panel including a plurality of pixels, the pixels being charged to a data voltage for displaying an input image in a display drive operation, electrical characteristics of the pixels being sensed in a sensing drive operation; and a driver integrated circuit configured to generate the data voltage in the display drive operation and sense the electrical characteristics of the pixels in the sensing drive operation, the driver integrated circuit including: a data voltage generator including a digital-to-analog converter converting a digital signal into an analog signal, the data voltage generator configured to generate the data voltage in the display drive operation and apply the data voltage to pixels of the display panel, a sensor connected to a sensing channel connected to the pixels of the display panel, the sensor configured to share the digital-to-analog converter with the data voltage generator, convert an analog sensing voltage from the sensing channel, which indicates electrical characteristics of the pixels, into digital sensing data in the sensing drive operation, and output the digital sensing data, and switching elements configured to selectively switch between the display drive operation and the sensing drive operation; and wherein the sensor includes: a sample and hold circuit connected to the sensing channel, the sample and hold circuit configured to sample the analog sensing voltage and output a sampling voltage; a comparator including a first input terminal connected to the sample and hold circuit and a second input terminal connected to the buffer, the comparator configured to compare the sampling voltage input to the first input terminal with an analog reference voltage input to the second input terminal; a control register connected to an output terminal of the comparator and configured to determine a digital output bit value in response to a comparison result of the comparator; the digital-to-analog converter connected to the control register and configured to convert a value of the control register into the analog reference voltage; and the buffer configured to stabilize the analog reference voltage input from the digital-to-analog converter and output the stabilized analog reference voltage to the second input terminal of the comparator.

* * * * *